United States Patent [19]

Campagna et al.

[11] 3,969,847

[45] July 20, 1976

[54] COMBINATION MANHOLE CLOSURE ASSEMBLY AND SEPARATE SUPPORT RING

[75] Inventors: Benjamin J. Campagna, Newark, Del.; Samuel A. Campagna, Jr., Deptford, N.J.

[73] Assignee: Benjamin J. Campagna, Newark, Del.

[22] Filed: Nov. 18, 1974

[21] Appl. No.: 524,537

[52] U.S. Cl. ..... 52/1; 52/19; 52/173 R; 137/512.1

[51] Int. Cl.[2] ..... E02D 29/14

[58] Field of Search ..... 52/1, 19, 20, 21, 173; 137/512.1, 527, 535, 525.5, 527.6

[56] References Cited

UNITED STATES PATENTS

| | | | |
|---|---|---|---|
| 793,214 | 6/1905 | Neuhaus | 137/535 |
| 1,238,878 | 9/1917 | Bravo | 137/527 |
| 1,281,406 | 10/1918 | Marquess | 52/21 |
| 2,663,268 | 12/1953 | Ahnell | 52/19 |
| 2,679,860 | 6/1954 | Diebold | 137/155 |
| 2,943,582 | 7/1960 | Bonanno | 52/20 |
| 3,415,272 | 12/1968 | Blackhawk | 137/512.1 |
| 3,538,946 | 11/1970 | Hilsheimer | 137/512.1 |
| 3,712,009 | 1/1973 | Campagna | 52/20 |
| 3,831,628 | 8/1974 | Kintner | 137/527 |

FOREIGN PATENTS OR APPLICATIONS

| | | | |
|---|---|---|---|
| 1,035,902 | 7/1966 | United Kingdom | 137/512.1 |

*Primary Examiner*—Stephen J. Novosad
*Assistant Examiner*—William Randolph

[57] ABSTRACT

Combination includes manhole closure assembly for preventing storm water from entering into manhole opening and separate support ring for assembly. Support ring has lower closure supporting flange with upper flange spaced therefrom, and sealing material is provided on lower flange. Closure assembly includes substantially circular cover plate engaging sealing material, and cover plate comprises pair of semi-circular segments. Structure is provided for holding semi-circular segments of cover plate together at diametral edge portions thereof. Spaced apart biasing structure is located along arcuate edge portions of cover plate, and such structure extends between plate and upper flange of support ring for urging plate against sealing material. When pressure force acting upon underside of cover plate exceeds force of biasing structure, arcuate edge portions of cover plate lift away from sealing material to relieve such pressure force.

11 Claims, 14 Drawing Figures

COMBINATION MANHOLE CLOSURE ASSEMBLY AND SEPARATE SUPPORT RING

Cross-Reference to Related Applications

The present application relates to U.S. Pat. No. 3,712,009, granted Jan. 23, 1973, and U.S. Pat. No. 3,798,848, granted Mar. 26, 1974.

BACKGROUND OF THE INVENTION

The present invention relates to the combination of a manhole closure assembly and a separate support ring, and more particularly to a closure and ring combination that prevents drainage and storm water from emptying into a manhole that leads to a sewerage system.

It is desirable to segregate sanitary or sewerage systems from those systems designed to handle storm and drainage water since such segregation reduces an unnecessary burden on the sewerage treatment facility. Obviously, when drainage and storm water empties into a sanitary system the sewerage treatment plant must necessarily handle and treat the storm water in addition to the sewerage material. Standard frames and covers for manholes that lead to sanitary or sewerage systems generally include heavy cover constructions with passageways therein that serve to vent the overall system for the purpose of relieving internal pressure as well as vacuum build-ups. The passageways in these manhole covers also enable storm water to empty into the sewerage system. It is impossible to simply seal off or otherwise eliminate the cover passageways since pressure developed within the sewerage system could easily produce a force sufficient to blow the cover away from its seated position at the manhole opening or blast the plugs away from the passageways. Additionally, pressure developed within the sewerage system can easily cause damage to the system if that pressure is not relieved.

With an oversized sewerage or sanitary system, storm water draining into the system does not present any significant problems. On the other hand, with many existing systems capacity is already at peak level, and it is estimated that 40 percent of that capacity is the direct result of storm or drainage water. For the most part, storm water volume draining into sewerage systems is much more acute today than it was many years ago, and the key factor is that today there is significantly less pervious area than there was even several years ago. This factor is due to larger impervious street areas that collect more drainage water as well as smaller building lot sizes which cut down on the amount of overall pervious area. Such factors have significantly contributed to the problem of overtaxing present sewerage systems. By significantly preventing storm and drainage water from emptying into such systems, existing facilities can easily handle an additional 60% or more sewerage capacity.

SUMMARY OF THE INVENTION

The primary object of the present invention is to provide a manhole closure assembly and an assembly support ring that together effectively and easily seal off a manhole opening in an efficient and highly economical manner to prevent drainage and storm water from emptying into the manhole while relieving pressure that may occur within the manhole.

In accordance with the present invention, a combination is provided comprising a manhole closure assembly for preventing storm water from emptying into a manhole opening and a separate support ring for the assembly. The support ring has a lower closure supporting flange with an upper flange spaced therefrom, and sealing material is located on the lower flange. The closure assembly includes a substantially circular cover plate the arcuate edge portions of which engage the sealing material on the lower flange, and the cover plate comprises a pair of semi-circular segments. An arrangement is provided for holding the semi-circular segments of the cover plate together at their diametral edge portions. Spaced apart biasing structure is located along the arcuate edge portions of the cover plate and the biasing structure extends between the plate and the upper flange of the support ring for urging the plate against the sealing material. When a pressure force acting upon the underside of the cover plate exceeds the force of the biasing structure the arcuate edge portions of the cover plate lift away from the sealing material to relieve such pressure force.

The arrangement for holding the semi-circular segments of the cover plate together at their diametral edge portions may include a support bar secured to the underside of one of the semi-circular segments along the diametral edge portion thereof and extending therefrom. The diametral edge portion of the other semi-circular segment rests upon the support bar, and structure on the upper side of the cover plate urges the other semi-circular segment against the support bar.

Continuing, each semi-circular segment of the cover plate may include a handle secured to the upper side thereof. Moreover, the biasing structure may comprise a plurality of coil springs. Preferably, the separate support ring has a side wall portion interconnecting the upper and lower flange portions with resilient material secured to the outside of the side wall portion. Also, the sealing material has an elevated portion in contact with the underside of the cover plate and a lower portion between the elevated portion and the side wall of the separate support ring. Sealing material may be applied between the diametral edges of the semi-circular segments of the cover plate.

BRIEF DESCRIPTION OF THE DRAWING

Novel features and advantages of the present invention in addition to those mentioned above will become apparent to those skilled in the art from a reading of the following detailed description in conjunction with the accompanying drawings wherein similar reference characters refer to similar parts and in which.

DETAILED DESCRIPTION OF THE INVENTION

Figure 1:
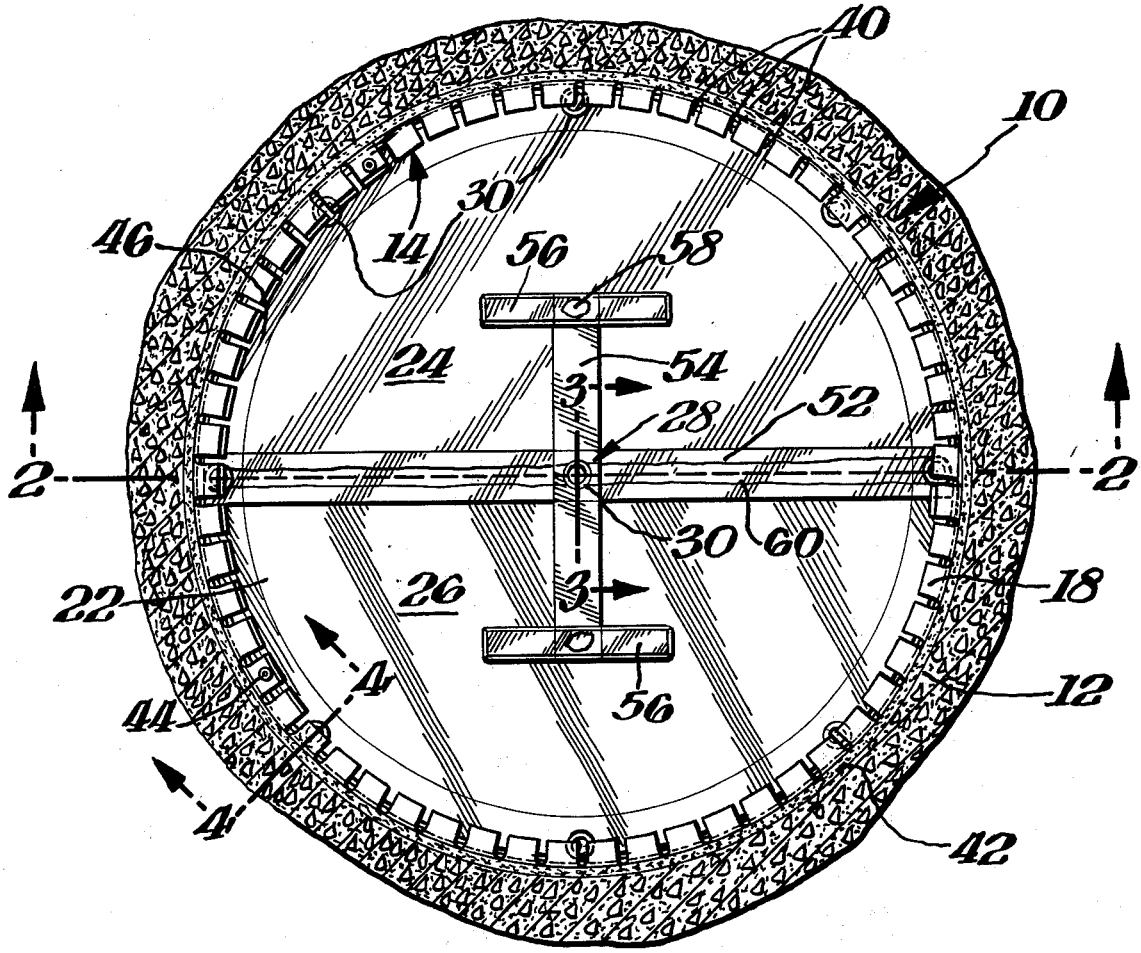
FIG. 1 is a top plan view of a manhole closure assembly and separate support ring combination, according to the present invention.

Referring in more particularity to the drawing, FIGS. 1–4 illustrate a combination comprising a manhole closure assembly 10 for preventing storm water from entering into a manhole 12 and a separate support ring 14 for the assembly. The separate ring 14 is designed for installation in the manhole 12 and serves to support the closure assembly 10 in covering relationship over the manhole. Particularly, the support ring includes a lower closure supporting flange 16 and an upper flange 18 is spaced therefrom, for reasons explained below. A sealing arrangement 20 rests upon the lower flange and the closure assembly 10 normally is adjacent the seal.

Figure 4:
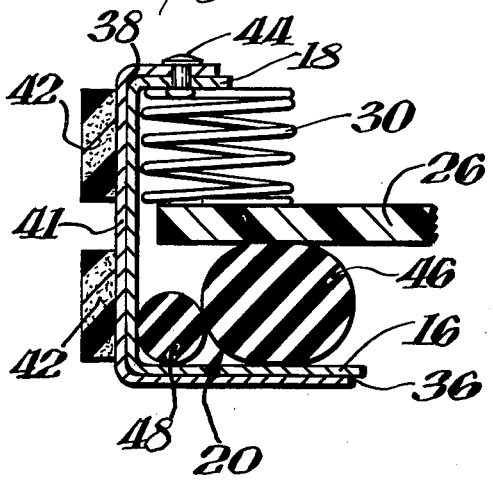
FIG. 4 is a sectional view taken along line 4—4 of FIG. 1.

The manhole closure assembly 10 of the combination includes a substantially circular cover plate 22 and the arcuate edge portions of the plate engage the sealing arrangement 20 on the lower flange 16 of the support ring 14. As shown best in FIG. 1, the cover plate comprises a pair of semi-circular segments 24, 26, and holding structure 28 is provided for maintaining the semi-circular segments of the cover plate together at their diametral edge portions. Biasing units in the form of coil springs 30 are spaced along the arcuate edge portions of the cover plate, and the springs 30 extend between the plate and the upper flange 18 of the support ring 14 for urging the plate against the sealing arrangement 20, as shown in FIG. 4. The closure assembly 10 remains in the position of FIG. 2 until a pressure force within the manhole 12 acting upon the underside of the cover plate exceeds the downward force exerted by the coil springs 30. When this imbalance occurs, the arcuate edge portions of the cover plate furthest removed from the diametral portions thereof lift away from the sealing arrangement 20 to relieve the internal pressure force generated within the manhole below the closure assembly and support ring. When the internal manhole pressure subsides, the coil springs 30 urge the manhole closure assembly 10 to its seated position illustrated in FIG. 2.

Most manholes include openings surrounded by an annular manhole frame 32. The frame includes a cover supporting flange 34 upon which the traditional manhole cover rests. In some instances, the frame may include a second inwardly directed flange and the second flange may serve as a support for a closure assembly that functions to prevent storm water from entering into the manhole opening. However, it is significant that a number of manhole frames do not include a second flange, and the absence of such structure necessitates a separate support for the closure assembly. Also, with a separate support, such as ring 14, it is possible to install the closure below the annular manhole frame 32. This eliminates water infiltration into the manhole from under the frame 32 as well as through the openings in the manhole cover.

Preferably, the separate support ring 14 comprises a two-piece arrangement connected together in end-to-end fashion by a weld, for example, and the free end of one of the pieces 36 is designed to telescope into the free end of the other piece 38. Each of the pieces 36, 38 has lower and upper inwardly directed portions which form the lower and upper flanges, 16 and 18, respectively, of the overall support ring. These upper and lower inwardly directed portions of the ring pieces 36, 38 include cutouts 40 which enable the ring pieces to be bent into a configuration corresponding to the opening where the ring is to be secured. Also, each of the ring pieces 36, 38 has an interconnecting portion extending between the upper and lower portions thereof. Together the interconnecting portions of the ring pieces 36, 38 form a ring side wall portion 41 of the support structure 14. The exterior surface of the side wall 41 has resilient material 42 secured thereto for anchoring the ring 14 in the manhole 12, as explained below.

Installation of the separate support ring 14 within the manhole 12 is accomplished by initially telescoping the free end of ring piece 36 into the open free end of ring piece 38. The support ring is then positioned in the manhole at the desired installation location and the ring is expanded into engagement with the side wall of the manhole. A mechanical device (not shown) may be used to expand the ring until the resilient material 42 secured to the exterior of the side wall portion 41 is sufficiently compressed and the ring is placed in compression. The telescoping portions of the ring pieces 36, 38 are then connected together by suitable fastening devices, such as rivets 44. The mechanical expanding device may then be removed to complete the support ring installation procedure.

Following installation of the ring 14, the sealing arrangement 20 is positioned on the lower flange 16 of the ring. Preferably, the sealing arrangement comprises an elevated portion 46 and a lower portion 48 located between the elevated portion and the side wall 41 of the support ring. The lower portion 48 of the sealing arrangement functions to properly locate the elevated portion 46 on the lower flange 16. Without the lower portion 48 of the sealing arrangement 20 it is possible that the elevated portion 46 might slide to one side or the other thereby causing it to contact the side wall 41 at one location and ride off of the lower flange 16 at another location.

After the sealing arrangement 20 is properly located on the lower flange 16 of the support ring, the semi-circular segments 24, 26 of the manhole closure assembly 10 are positioned in engagement with the seal. The coil springs 30 may then be positioned between the arcuate edge portions of the cover plate and the upper flange 18 of the support ring, as best shown in FIG. 4.

The structure for holding the semi-circular segments 24, 26 together at their diametral edge portions includes a support bar 50 secured to the underside of plate segment 24 along the diametral edge portion thereof and extending therefrom. The diametral edge portion of the other semi-circular segment 26 rests upon the support bar 50, and the plate segment 26 is urged against the upper bar 50 by a hold-down bar 52. The hold-down bar extends across the diametral edge portions of the plate segments, and a coil spring 30 reacts between the bar 52 and a mounting strip 54.

Figure 2:
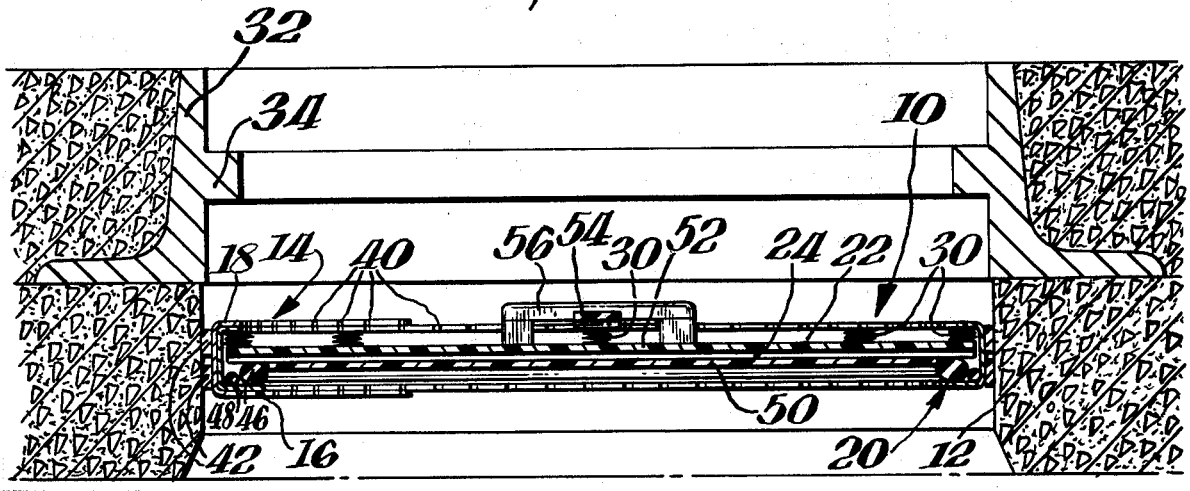
FIG. 2 is a sectional view taken along line 2—2 of FIG. 1.
Figure 3:
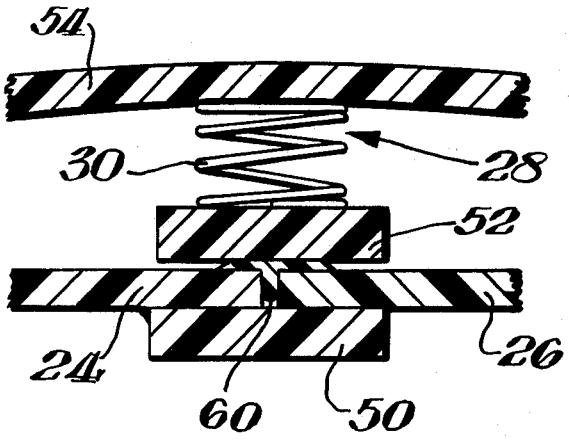
FIG. 3 is an enlarged sectional view taken along line 3—3 of FIG. 1.

Each of the semi-circular segments 24, 26 of the closure assembly includes a handle 56, and the mounting strip 54 simply extends from the underside of one handle to the underside of the handle on the other plate segment, as shown best in FIGS. 1 and 2. Mastic-type sealing material may be located between the mounting strip 54 and each handle 56 at 58 to prevent the strip from shifting. Also, mastic-type sealing material 60 is located between the diametral edge portions of the semi-circular segments 24, 26 of the cover plate 22.

The present invention serves to relieve internal pressure developed in the manhole 12 below the closure assembly 10 and separate support ring 14. When the pressure force in the manhole exceeds the downward force exerted by the coil springs 30, the arcuate edge portions of the cover plate lift away from the sealing arrangement 20 to vent the manhole. The closure assembly 10 returns to its closed or seated position when the force of the coil springs 30 exceeds the pressure force within the manhole. With the exception of several manhole openings, each of the manhole openings of an overall system may include an arrangement similar to the combination closure 10 and support ring 14. The several openings which do not include this arrangement may be provided with both pressure and vacuum relief valves of the type disclosed in U.S. Pat. Nos. 3,712,009 and 3,798,848 in order to vent the system of vacuum build-ups.

Figure 6:
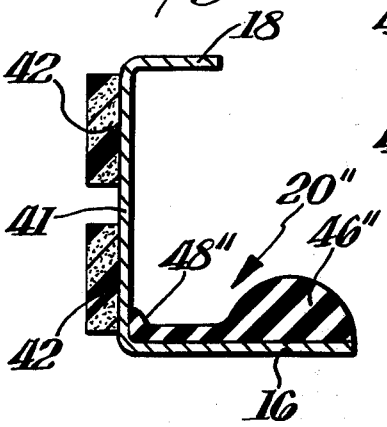
FIG. 6 is a view similar to FIG. 4 showing another alternate sealing arrangement.
Figure 5:
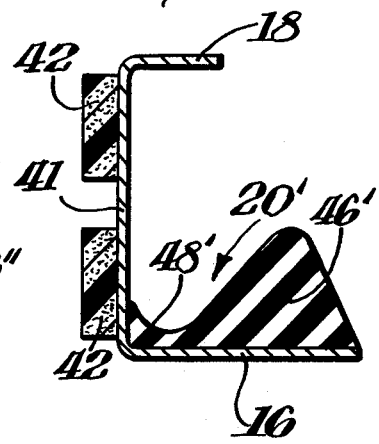
FIG. 5 is a view similar to FIG. 4 showing an alternate sealing arrangement.
Figure 7:
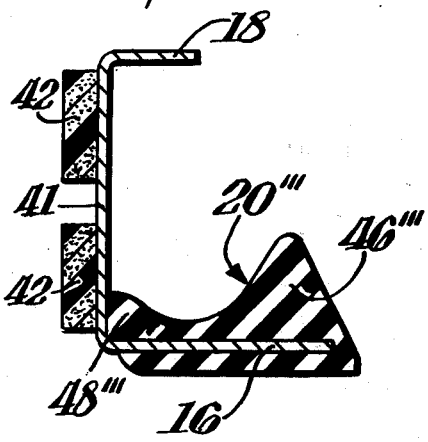
FIG. 7 is a view similar to FIG. 4 showing still another alternate sealing arrangement.

FIGS. 5, 6 and 7 illustrate alternates of the sealing arrangement 20 upon which the manhole closure assembly rests, and similar reference characters identify similar parts. The sealing arrangement 20' shown in FIG. 5 includes an elevated portion 46' and a lower portion 48'. Unlike arrangement 20 the sealing arrangement 20' is a one-piece construction. Otherwise, the elevated and lower portions of the arrangement 20' function in the same manner as the arrangement 20. The sealing arrangement 20'' shown in FIG. 6 includes an elevated portion 46'' and the lower portion 48'', each of which functions in the same manner as discussed above in conjunction with the arrangements 20 and 20'. Still another sealing arrangement 20''' is shown in FIG. 7. Here again, the arrangement includes an elevated portion 46''' and a lower portion 48''' each of which functions in the manner as described above in conjunction with the other embodiments.

Figure 8:
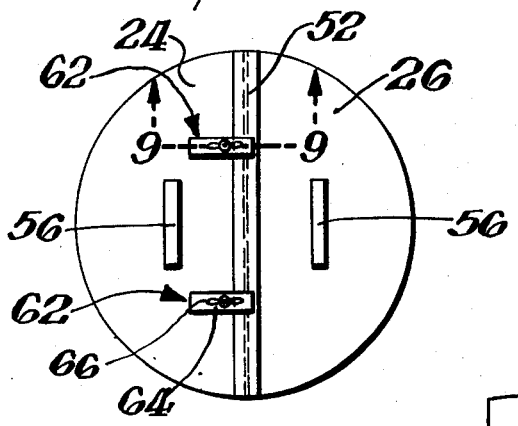
FIG. 8 is a top plan view of a modified manhole closure assembly, according to the present invention.
Figure 9:
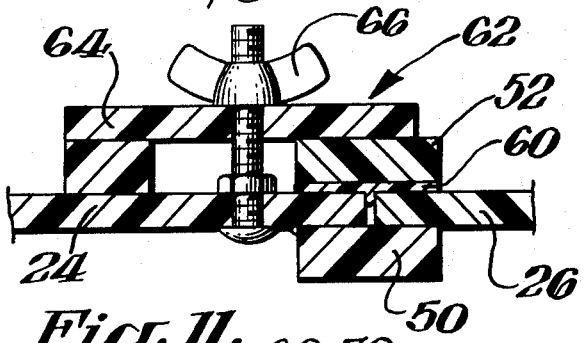
FIG. 9 is a sectional view taken along line 9—9 of FIG. 8.

Alternate structure 62 for holding the semi-circular segments 24, 26 together at their diametral edge portions is shown in FIGS. 8 and 9. The arrangement of FIGS. 8 and 9 differs from the arrangement of FIGS. 1–4 in that it does not include a mounting strip 54 and coil spring 30. Instead, a pair of spaced apart L-shaped brackets 64 is provided, and fasteners 66 extend through openings in the plate segment 24 and the brackets 64 for urging the hold-down bar 52 against the diametral edge portions of the semi-circular plate segments. After the separate support ring 14 is installed in the manhole 12 and the plate segments mounted upon the sealing arrangement 20, as explained above, mastic-type sealing material 60 is applied between the diametral edge portions of the semi-circular plate segments and the hold-down bar is urged against the seal 60. Finally, the L-shaped brackets are positioned as shown in FIG. 9 and the fasteners 66 tightened to hold the semi-circular plate segments together.

Figure 11:
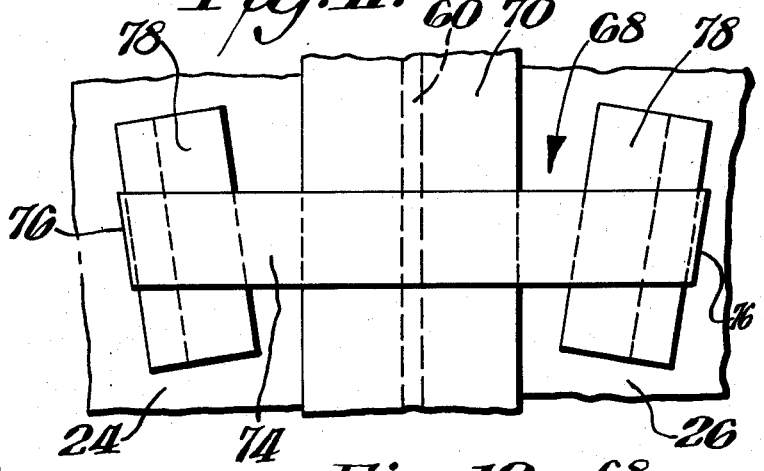
FIG. 11 is an enlarged partial top plan view of the holding structure of the assembly of FIG. 10.
Figure 10:
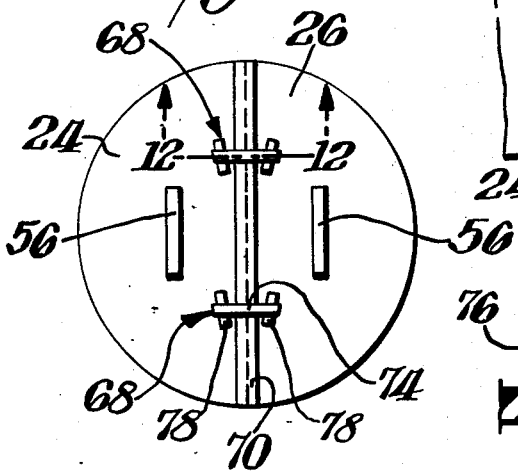
FIG. 10 is a top plan view of another manhole closure assembly, according to the present invention.
Figure 12:
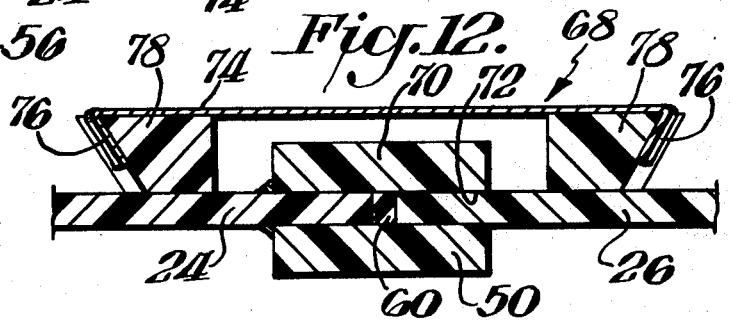
FIG. 12 is a sectional view taken along line 12—12 of FIG. 10.

FIGS. 10, 11 and 12 illustrate another structural arrangement 68 for holding the semi-circular segments 24, 26 of the cover plate together at their diametral edge portions. In addition to the support bar 50, arrangement 68 includes an upper support bar 70 which is anchored to the segment 24, as shown in FIG. 12. Together, the upper and lower support bars 50, 70 define a channel 72 for receiving the diametral edge portion of the plate segment 26. Mastic-type sealing material 60 is located between the diametral edge portions of the plate segments. The segments are held together by an anchor strip 74 having down-turned ends 76 that fit over blocks 78, one secured to the upper side of each plate segment, as shown in FIG. 12. The blocks 78 are angled away from the diametral edge portions of the plate segments so that the segments are urged toward one another when the anchor strip 74 is urged onto the angled blocks 78, as is clear from the drawing.

Figure 13:
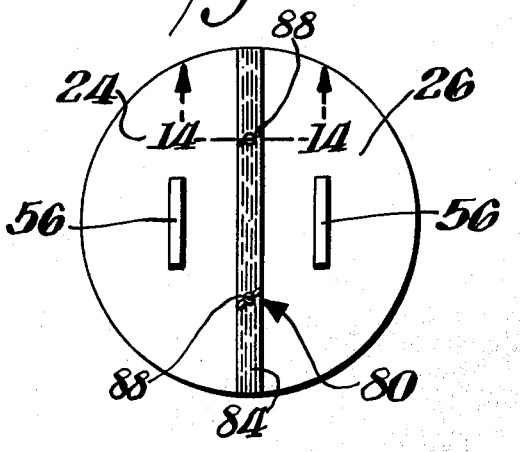
FIG. 13 is a top plan view of still another manhole closure assembly, according to the present invention.
Figure 14:
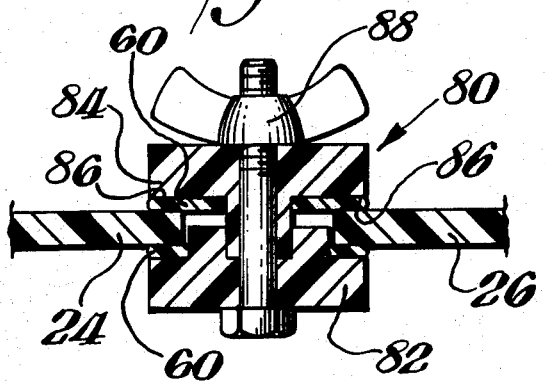
FIG. 14 is a sectional view taken along line 14—14 of FIG. 13.

FIGS. 13 and 14 show another arrangement 80 for holding the semi-circular segments 24, 26 of the cover plate together at their diametral edge portions. The arrangement 80 includes a lower bar 82 constructed and arranged to cooperate with an upper bar 84 to provide a pair of opposite channels 86 that receive the diametral edge portions of the cover plate segments. Sealing material 60 is located in the channels 86, and a fastener 88 extends through the upper and lower bars 82 and 84 for urging the bars together. Ultimately, the diametral edge portions of the cover plate segments are sandwiched between the bars 82 and 84 of the holding arrangement 80.

What is claimed is:

1. The combination of a manhole closure assembly for preventing storm water from entering into a manhole opening and a separate support ring for the assembly including a lower closure supporting flange, an upper flange spaced therefrom, and sealing means on the lower flange, the closure assembly including a substantially circular cover plate the arcuate edge portions of which engage the sealing means on the lower flange and the cover plate comprising a pair of semi-circular segments, means for holding the semi-circular segments of the cover plate together at their diametral edge portions while allowing movement of at least one segment about a substantially horizontal axis in close proximity to its diametral edge portion, and spaced apart biasing means along the arcuate edge portions of the cover plate extending between the plate and the upper flange of the support ring for urging the plate against the sealing means until a pressure force acting upon the underside of the cover plate exceeds the force of the biasing means whereby the arcuate edge portions of the cover plate lift away from the sealing means to relieve such pressure force.

2. The combination of claim 1 including a handle secured to the upper side of each semi-circular segment of the cover plate.

3. The combination of claim 1 in which the separate support ring has a side wall portion interconnecting the upper and lower flange portions, and resilient material means secured to the outside of the side wall portion.

4. The combination of claim 1 in which the biasing means comprises a plurality of coil springs.

5. The combination of claim 1 in which the separate support ring has a side wall portion interconnecting the upper and lower flange portions, and in which the sealing means comprises an elevated portion in contact with the underside of the cover plate and a lower portion between the elevated portion and the side wall portion of the separate support ring.

6. The combination of claim 1 including sealing material between the diametral edge portions of the semi-circular segments of the cover plate.

7. The combination of a manhole closure assembly for preventing storm water from entering into a manhole opening and a separate support ring for the assembly including a lower closure supporting flange, an upper flange spaced therefrom, and sealing means on the lower flange, the closure assembly including a substantially circular cover plate the arcuate edge portions of which engage the sealing means on the lower flange and the cover plate comprising a pair of semi-circular segments, means for holding the semi-circular segments of the cover plate together at their diametral edge portions including a support bar secured to the underside of one of the semi-circular segments along the diametral edge portion thereof and extending therefrom, the diametral edge portion of the other semi-circular segment resting upon the support bar, and means on the upper side of the cover plate urging the other semi-circular segment against the support bar, and spaced apart biasing means along the arcuate edge portions of the cover plate extending between the plate and the upper flange of the support ring for urging the plate against the sealing means until a pressure force acting upon the underside of the cover plate exceeds the force of the biasing means whereby the arcuate edge portions of the cover plate lift away from the sealing means to relieve such pressure force.

8. The combination of claim 7 including a handle secured to the upper side of each semi-circular segment of the cover plate.

9. The combination of claim 7 in which the separate support ring has a side wall portion interconnecting the upper and lower flange portions, and resilient material means secured to the outside of the side wall portion.

10. The combination of claim 7 in which the biasing means comprises a plurality of coil springs.

11. The combination of claim 7 including sealing material between the diametral edge portions of the semi-circular segments of the cover plate.

* * * * *